US010617601B1

(12) United States Patent
Wilkinson

(10) Patent No.: US 10,617,601 B1
(45) Date of Patent: Apr. 14, 2020

(54) WATER IMMERSION MASSAGE TABLE

(71) Applicant: David L. Wilkinson, Salem, OR (US)

(72) Inventor: David L. Wilkinson, Salem, OR (US)

(73) Assignee: David L. Wilkinson, Salem, OR (US)

( * ) Notice: Subject to any disclaimer, the term of this patent is extended or adjusted under 35 U.S.C. 154(b) by 0 days.

(21) Appl. No.: 16/350,323

(22) Filed: Nov. 5, 2018

(51) Int. Cl.

| | |
|---|---|
| ***A61H 35/00*** | (2006.01) |
| ***A47K 3/022*** | (2006.01) |
| ***A61H 33/00*** | (2006.01) |
| ***A61H 7/00*** | (2006.01) |

(52) U.S. Cl.
CPC ..... *A61H 35/008* (2013.01); *A47K 3/022* (2013.01); *A61H 7/00* (2013.01); *A61H 33/0095* (2013.01); *A61H 2033/0033* (2013.01); *A61H 2201/0207* (2013.01); *A61H 2201/102* (2013.01); *A61H 2201/1642* (2013.01); *A61H 2203/0456* (2013.01)

(58) Field of Classification Search
CPC ..... A61H 35/008; A61H 7/00; A61H 2033/0033; A61H 2201/0207; A61H 2201/102; A61H 2201/1642; A61H 2203/0456; A47K 3/022
USPC ..... 4/548
See application file for complete search history.

(56) References Cited

U.S. PATENT DOCUMENTS

| | | | | | |
|---|---|---|---|---|---|
| 3,800,336 | A * | 4/1974 | Hoxeng | A47K 3/06 | 4/587 |
| 3,803,642 | A * | 4/1974 | Erling | A47K 3/06 | 4/587 |
| 4,207,629 | A * | 6/1980 | Kagawa | A47K 3/022 | 4/540 |
| 4,216,552 | A * | 8/1980 | Gurolnick | A47K 3/034 | 4/548 |
| 4,221,009 | A * | 9/1980 | Wright | A47K 3/022 | 4/566.1 |
| D289,791 | S * | 5/1987 | Schremmer | D23/278 | |
| 5,459,887 | A * | 10/1995 | Roman | A47K 3/022 | 4/541.2 |
| 5,539,939 | A * | 7/1996 | Gesse | A47K 3/022 | 4/573.1 |
| 5,678,257 | A * | 10/1997 | Morcate | A47K 3/06 | 4/540 |
| 5,909,970 | A * | 6/1999 | Velazquez | A61G 7/0005 | 4/585 |

* cited by examiner

*Primary Examiner* — Benjamin R Shaw

(57) ABSTRACT

A water holding container (1) supported by a base (7, 8, 9) that allows a Massage Therapist to administer massage therapy to a client immersed in heated water. An inclined floor base (2) at one end of the container positions a client's face above the water level. A removable toe support (4) helps a shorter client to keep his/her face above the water level.

1 Claim, 4 Drawing Sheets

WATER IMMERSION MASSAGE TABLE

CROSS REFERENCE TO RELATED APPLICATIONS

This application claims the benefit of provisional patent application Ser. No. 62/585,836 filed Nov. 14, 2017.

SUMMARY

The Water Immersion Massage Table is a water holding container where a client can lie in a supine position; and be immersed in water up to his/her neck while receiving massage therapy. The container is supported by a base that allows the therapist to stand while administering the massage.

Advantages

This table increases the efficiency and productivity of time spent in a rehabilitative massage session. Two important aspects of rehabilitative massage are 1) the breaking down and smoothing out of myofascial tissue and 2) stabilizing the neuromuscular system. Fascia softens and becomes more pliable as a client soaks in heated water. Since, the human body is less dense than water, the soft tissue is buoyant and therefore more easily broken down while suspended in water. Furthermore, beneficial minerals and essential oils can be dissolved in the water. The warm and buoyant environment of this table triggers the parasympathetic nervous system which allows the client to calm down and relax. As fascia is more easily softened and broken down, nerves are also more efficiently released from entrapment. This table allows a massage therapist to stand and deliver massage therapy at a height that he/she is accustomed to with the added benefits of the client being immersed in heated water.

DRAWINGS

Figures

DRAWINGS

Reference Numerals

Figure 1:
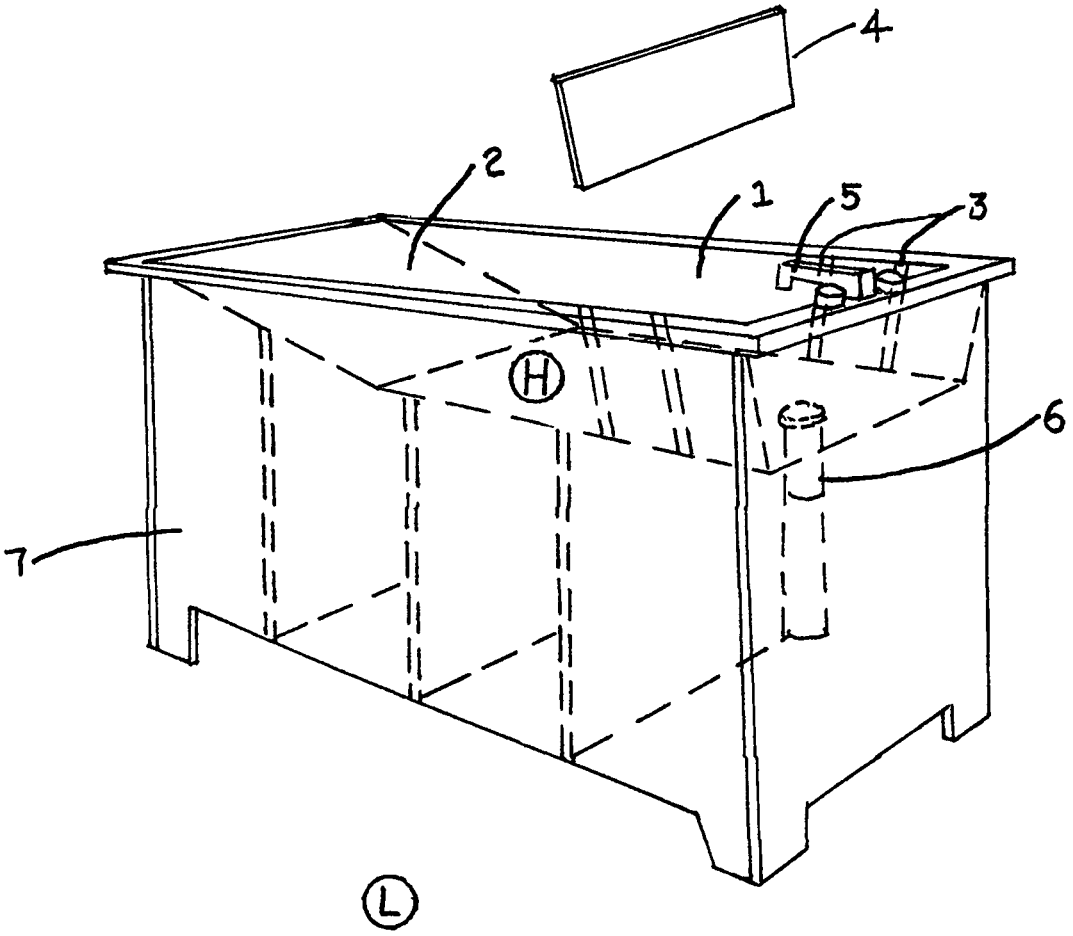
FIG. 1 shows a standing view of the Water Immersion Massage Table mounted on a sturdy, permanent base.

1 Water holding container
2 Inclined floor base
3 Groove
4 Removable toe support
5 Faucet
6 Drain
7 Permanent base
8 Portable base
9 Hydraulic lift table
10 Accordion hose L Step ladder H Water immersion heater
H Water immersion heater D Floor drain

DETAILED DESCRIPTION

FIG. 1—First Embodiment

The Water Immersion Massage Table consists of a water holding container 1 that is deep enough for a client to be immersed up to his/her neck in water while lying in a supine position. At one end of the table is a faucet 5 or water source and a drain 6. Grooves 3 in the side wall at this end allow for a removable toe support 4 to be held in place. At the opposite end of the table is an inclined floor base 2 to support the upper body of the client. The table is mounted on a permanent base 7 that supports the weight of the table, clients, and water.

Figure 4:
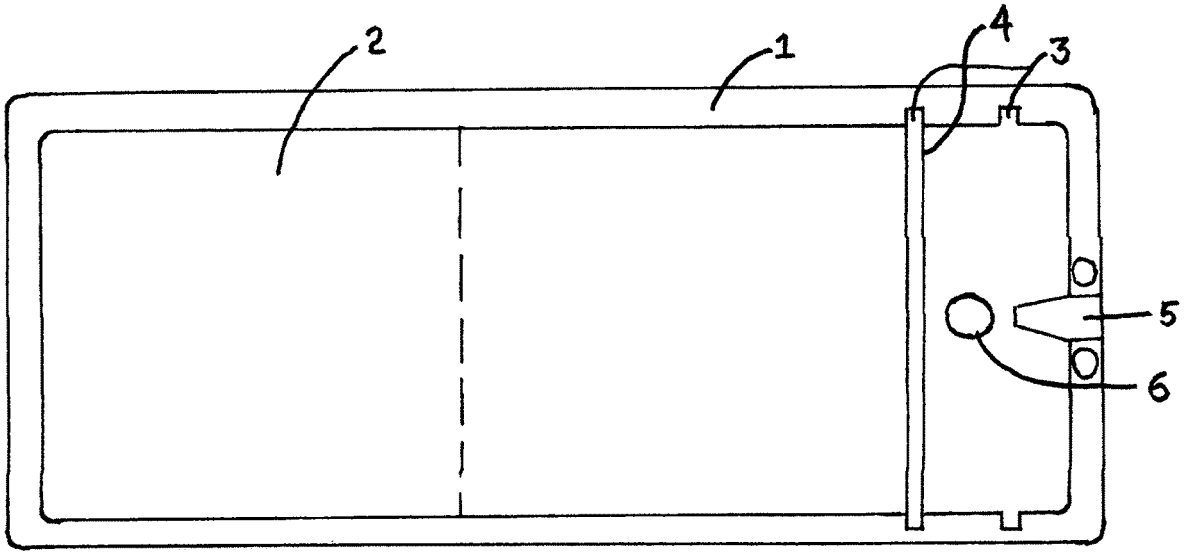
FIG. 4 shows a bird's eye view of the Water Immersion Massage Table revealing the removable toe support and grooves for securing it.

Operation—FIGS. 1 and 4

The water holding container 1 is filled from the faucet 5 or water source with heated water at or near 104 degrees Fahrenheit. The temperature may be maintained by use of a Water Immersion Heater H. Selected Essential Oils and/or Minerals may be dissolved in the water. The client, clothed in personal swimwear, is helped into the container by use of a step ladder L. The client then lies back in the water so that they are in a supine position. His/her upper body is angled upward, supported by the inclined floor base 2 so that his/her face is above the water line.

A shorter client may place his/her toes against a removable toe support 2 to aid in maintaining his/her face position above the water line. The removable toe support 2 slides into one of the set of grooves 3 that best aligns with the height of the client. From this position, the client is mainly supported by the neck, whereas the buoyant body can easily be lifted, moved from side to side, and be rotated in the water. Massage oil is applied to the skin of the clients so that the therapist's hands and tools glide under water while administering the massage. Upon conclusion, the client is assisted from the container by use of a step ladder L. They then move to a conventional massage table to receive a full-body stretching session administered by the therapist. Water is then released through the drain 6 so that the water holding container can be cleaned. The permanent base 7 allows for the table to be permanently plumbed to the building's sources.

Figure 2:
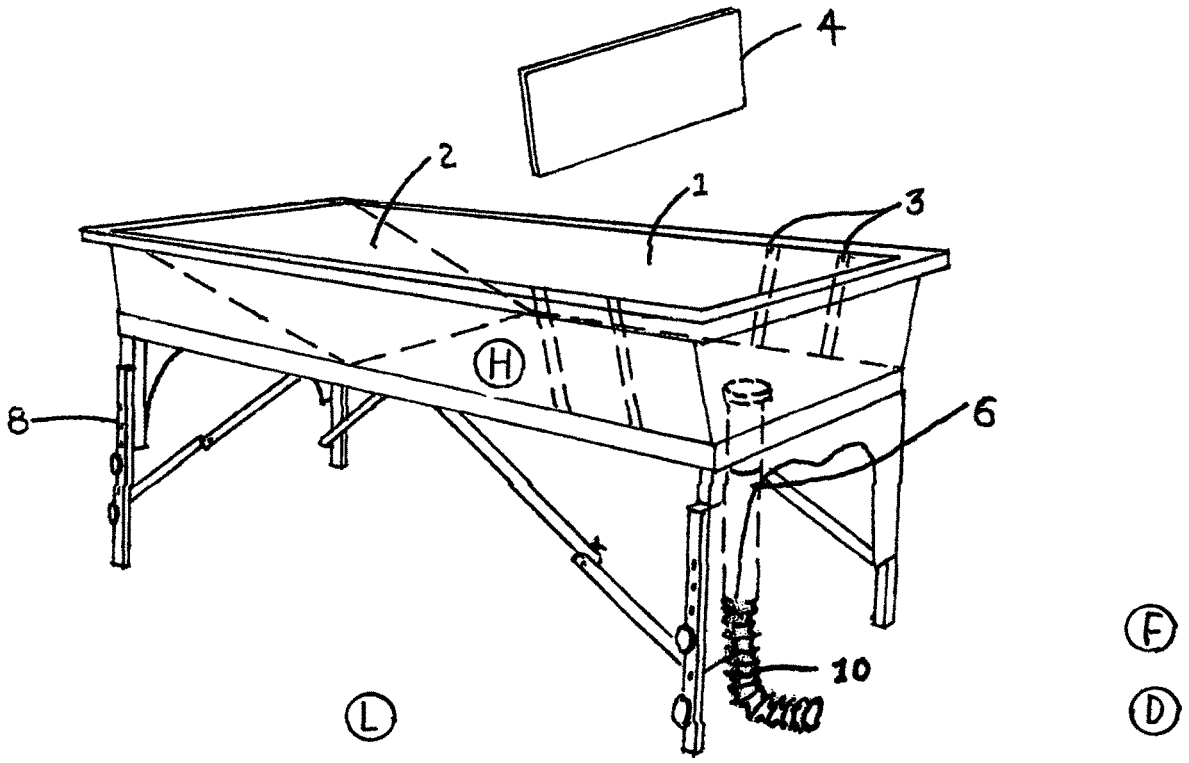
FIG. 2 shows a standing view of the Water Immersion Massage Table mounted on a portable base equipped with collapsible and height-adjusting legs.

FIG. 2—Alternate Embodiment

The Water Immersion Massage Table may also be mounted onto a portable base 8 like the base of a portable massage table with adjustable legs to allow the table height to be moved up and down. This base can also be collapsed so that the legs fold up and the base can be folded in half.

Operation—FIG. 2

This table is designed to be mobile, so it can be filled through a hose attached to an exterior faucet F. It needs to be drained into or onto a floor drain D. A short accordion hose is attached to the table drain to help direct the drain-off to the floor drain. All other operation is the same as the first embodiment. This allows for a more versatile table that can be used by multiple therapists. It also allows for the table to be compacted and more easily moved to other events and locations.

Figure 3:
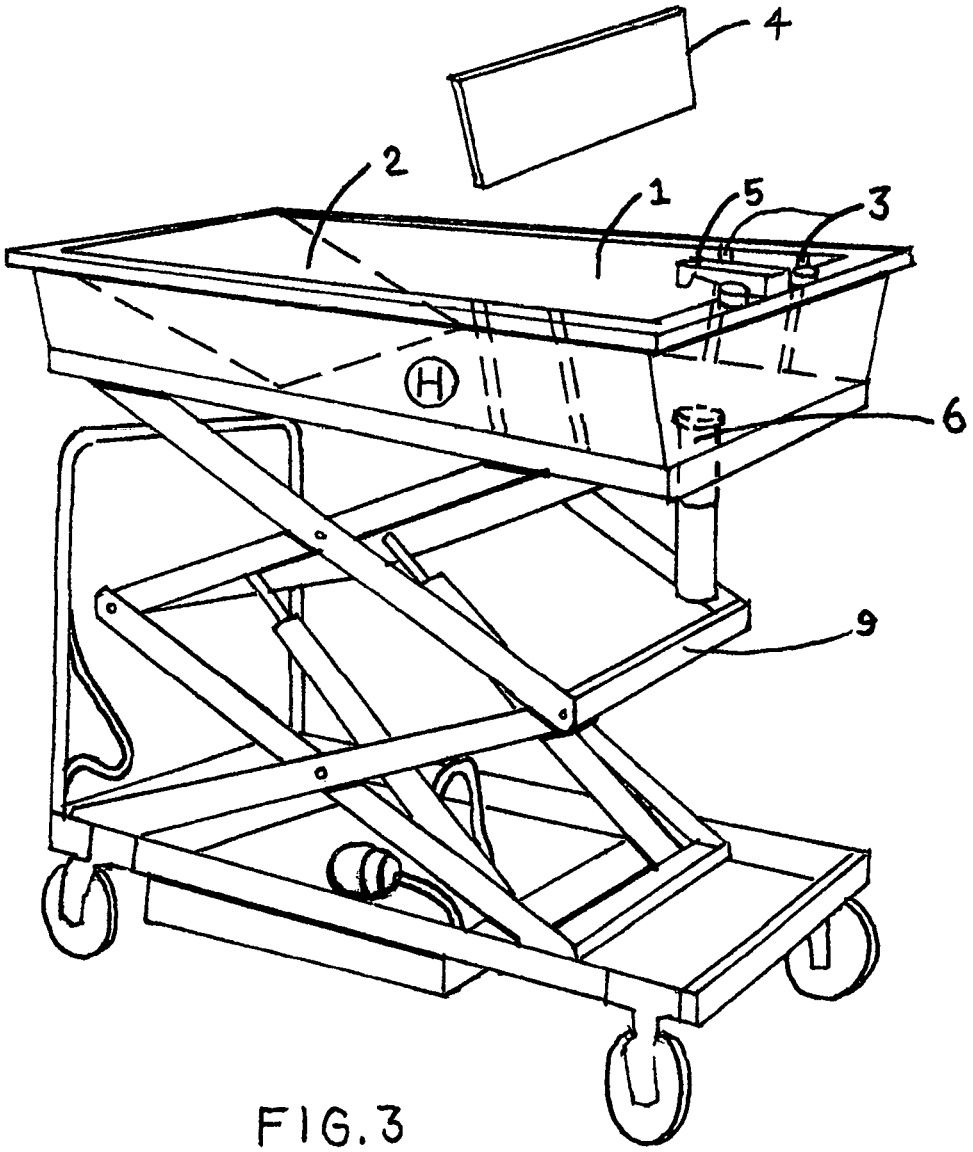
FIG. 3 shows a standing view of the Water Immersion Massage Table mounted on a hydraulic lift table.

FIG. 3—Second Alternate Embodiment

The Water Immersion Massage Table may also be mounted onto a hydraulic lift table 9.

Operation—FIG. 3

This embodiment operates in the same manner as the first embodiment, except the client enters the water holding container at ground level and then is lifted to the appropriate height by use of a hydraulic lift table 9. At conclusion, the client is lowered to exit at ground level. This embodiment can either be a mobile or permanent fixture. Therefore, it can either be plumbed into the building's water and drain source as in the first embodiment, or it can be filled through a hose and drained through a floor drain as in the first alternate embodiment.

CONCLUSIONS, RAMIFICATIONS, AND SCOPE

Accordingly, the reader will see that the Water Immersion Massage Table can be a valuable addition to the Massage Therapy world of Rehabilitative Massage. As a client is immersed in heated water, fascia is softened and transformed for more efficient breaking down and smoothing of the tissue. Soft tissue is more efficiently manipulated because of space created by the buoyancy of the human body in water. Nerves are calmed by the warm and buoyant environment; as well as, more easily released from entrapment because of the softening of the fascia. Selected minerals and essential oils may also be dissolved in the water for additional health benefits.

This treatment can be especially effective for the elderly and for athletes competing in multiple competitions on consecutive days. Since the body experiences less trauma while receiving deep rehabilitative work, the client experiences less bruising and soreness; and therefore, can return to activity without discomfort sooner than with traditional massage therapy.

The three embodiments included in this application show examples of three different forms of mounting this table so that a Massage Therapist can administer a Water Immersion Massage at the same height that they perform a traditional massage. The options can be chosen according to the number of therapists using the table, the number of places the table is to be used, the mobility of clients that will be using the table, and the budget available.

Although the descriptions in this application contains many specificities, these should not be construed as limiting the scope of the embodiments. Rather, they are merely providing illustrations of some of several possible embodiments. For example, the water holding container could have other shapes such as oval or trapezoidal. It could be longer, shorter, or deeper in relationship to its width. It could have more removable toe supports. It could be equipped with jet propulsion or be heated by a convection heater.

Thus, the scope of the embodiments should be determined by the appended claims rather than by the examples given.

I claim:

1. A water immersion massage table for performing massage therapy on a client immersed in water comprising, a water holding container configured to be filled with hot water and having a sloped end to support the upper body of the client while lying in a supine position so that the client's face is above the water level; and wherein said water holding container further comprises at least two side walls, each sidewall having a plurality of grooves therein, wherein the grooves are configured to receive a removable toe support spanning between the sidewalls; and wherein said water holding container is positioned at a height wherein a therapist can stand and effectively administer massage therapy to the client; and wherein said water holding container is further configured to be deep enough such that a client can be immersed up to his-her neck in water while lying in a supine position such that the client is mainly supported by the neck and wherein the buoyant body of the client can be easily lifted, moved from side to side, and rotated in the water.

* * * * *